US008960308B2

(12) United States Patent
Nguyen et al.

(10) Patent No.: US 8,960,308 B2
(45) **Date of Patent: *Feb. 24, 2015**

(54) METHODS AND DEVICES FOR ISOLATING WELLHEAD PRESSURE

(71) Applicant: Cameron International Corporation, Houston, TX (US)

(72) Inventors: Dennis P. Nguyen, Pearland, TX (US); David Anderson, Denver, CO (US); Delbert Vanderford, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/035,875

(22) Filed: Sep. 24, 2013

(65) Prior Publication Data

US 2014/0020894 A1 Jan. 23, 2014

Related U.S. Application Data

(63) Continuation of application No. 12/920,824, filed as application No. PCT/US2009/035028 on Feb. 24, 2009, now Pat. No. 8,544,551.

(60) Provisional application No. 61/041,154, filed on Mar. 31, 2008.

(51) Int. Cl.

| | |
|---|---|
| ***E21B 33/068*** | (2006.01) |
| ***E21B 34/02*** | (2006.01) |
| ***E21B 33/00*** | (2006.01) |

(52) U.S. Cl.

CPC ..... *E21B 33/068* (2013.01); *E21B 34/02* (2013.01); *E21B 33/00* (2013.01)

USPC ..... 166/368; 166/75.11; 166/192

(58) Field of Classification Search

CPC ..... E21B 33/03; E21B 33/035; E21B 33/043; E21B 33/12; E21B 33/134; E21B 34/02; E21B 34/06

USPC ..... 166/368, 75.11, 192, 316; 137/15.18, 137/15.24, 315.02, 315.42

See application file for complete search history.

(56) References Cited

U.S. PATENT DOCUMENTS

| | | | | |
|---|---|---|---|---|
| 2,250,244 | A | 7/1941 | Yancey | |
| 3,473,555 | A | 10/1969 | Martin et al. | |
| 4,019,541 | A | 4/1977 | Koppl | |
| 4,184,504 | A | 1/1980 | Carmichael et al. | |
| 4,503,879 | A | 3/1985 | Lazarus | |
| 4,657,075 | A * | 4/1987 | McLeod | 166/72 |
| 4,991,650 | A | 2/1991 | McLeod | |
| 8,544,551 | B2 * | 10/2013 | Nguyen et al. | 166/368 |

OTHER PUBLICATIONS

International Search Report & Written Opinion of PCT/US2009/035028 dated Jan. 22, 2010.

* cited by examiner

*Primary Examiner* — Daniel P Stephenson
(74) *Attorney, Agent, or Firm* — Fletcher Yoder P.C.

(57) ABSTRACT

A wellhead is provided. In one embodiment, the wellhead includes a plug for sealing a side passage of the wellhead. The plug may include an outer member, an inner member extending through the outer member and coupled to the outer member with at least one degree of freedom of movement relative to the outer member, and a moveable seal disposed around the outer member. In some embodiments, the moveable seal is configured to seal against the side passage in response to being moved on the outer member by the inner member.

34 Claims, 16 Drawing Sheets

METHODS AND DEVICES FOR ISOLATING WELLHEAD PRESSURE

CROSS REFERENCE TO RELATED APPLICATIONS

This application claims priority to and benefit of U.S. Non-Provisional patent application Ser. No. 12/920,824, entitled "Methods and Devices for Isolating Wellhead Pressure", filed on Sep. 2, 2010, which is herein incorporated by reference in its entirety, which claims priority to and benefit of PCT Application No. PCT/US2009/035028, entitled "Methods and Devices for Isolating Wellhead Pressure", filed on Feb. 24, 2009, which is herein incorporated by reference in its entirety, and which claims priority to U.S. Provisional Patent Application No. 61/041,154, entitled "Methods and Devices for Isolating Wellhead Pressure", filed on Mar. 31, 2008, which is herein incorporated by reference in its entirety.

FIELD OF THE INVENTION

The present invention relates generally to devices that couple to wellheads. More particularly, the present invention, in accordance with certain embodiments, relates to devices configured to isolate portions of wellheads from fluid pressure.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are frequently used to extract fluids, such as oil, gas, and water, from subterranean reserves. These fluids, however, are often expensive to extract because they naturally flow relatively slowly to the well bore. Frequently, a substantial portion of the fluid is separated from the well by bodies of rock and other solid materials and may be located in isolated cracks within a formation. These solid formations impede fluid flow to the well and tend to reduce the well's rate of production.

This effect, however, can be mitigated with certain well-enhancement techniques. Well output often can be boosted by hydraulically fracturing the rock disposed near the bottom of the well, using a process referred to as "fracing." To frac a well, a fracturing fluid is pumped into the well until the down-hole pressure rises, causing cracks to form in the surrounding rock. The fracturing fluid flows into the cracks, causing the cracks to propagate away from the well and toward more distant fluid reserves. To impede the cracks from closing after the fracing pressure is removed, the fracturing fluid typically carries a substance referred to as a proppant. The proppant is typically a solid, permeable material, such as sand, that remains in the cracks and holds them at least partially open after the fracturing pressure is released. The resulting porous passages provide a lower-resistance path for the extracted fluid to flow to the well bore, increasing the well's rate of production.

Fracing a well often produces pressures in the well that are greater than the pressure-rating of certain well components. For example, some wellheads are rated for pressures up to 5,000 psi, a rating which is often adequate for pressures naturally arising from the extracted fluid. However, some fracing operations, which are temporary procedures and encompass a small duration of a well's life, can produce pressures that are greater than 10,000 psi. Thus, there is a need to protect some well components from fluid pressure arising during the short duration fracing is occurring.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," "said," and the like, are intended to mean that there are one or more of the elements. The terms "comprising," "including," "having," and the like are intended to be inclusive and mean that there may be additional elements other than the listed elements. Moreover, the use of "top," "bottom," "above," "below," and variations of these terms is made for convenience, but does not require any particular orientation of the components.

Figure 1:
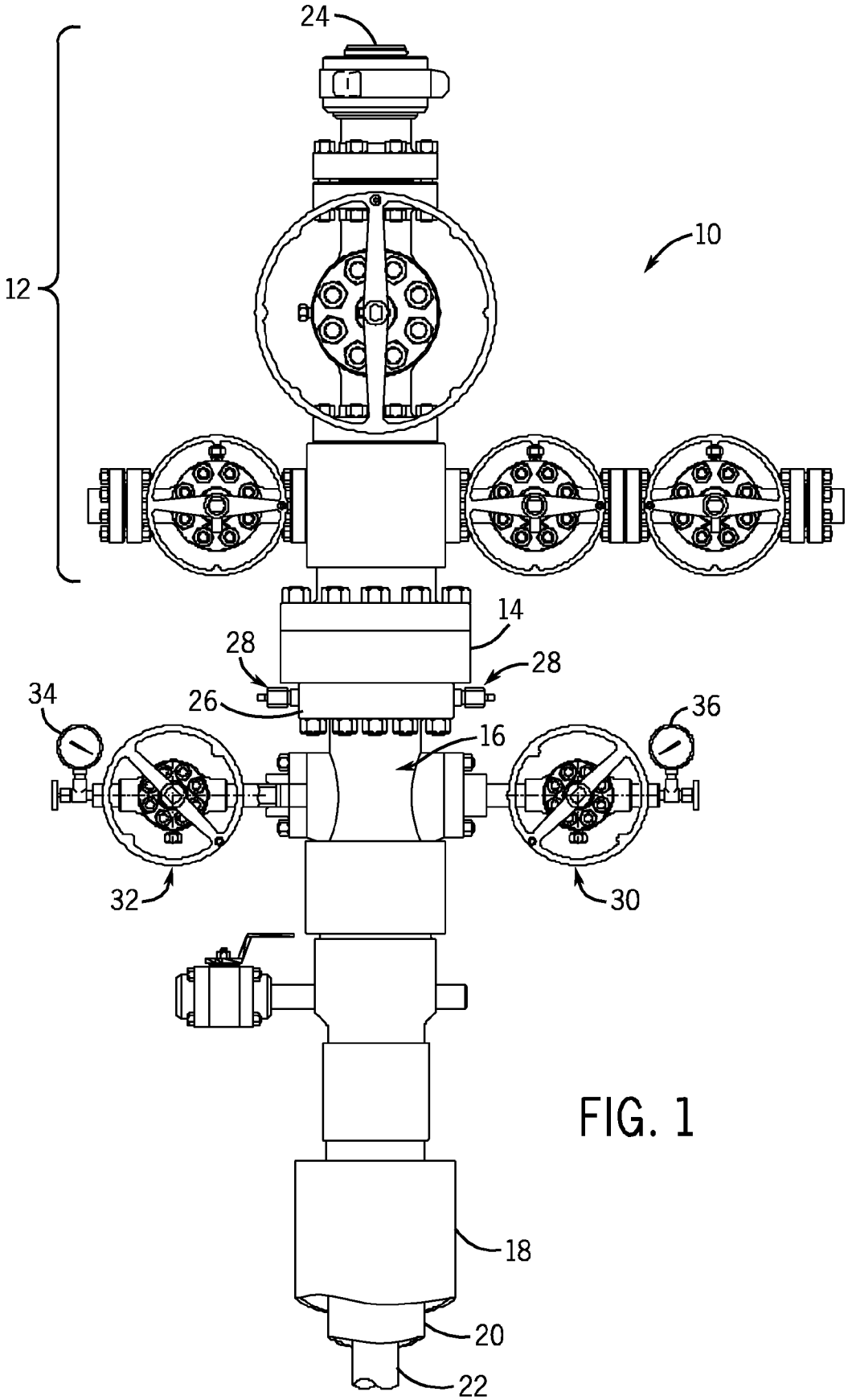
FIG. 1 is a side view of an embodiment of a wellhead.

FIG. 1 illustrates an embodiment of a wellhead 10. In this embodiment, the wellhead 10 is a surface wellhead, but other embodiments may include a subsea wellhead. The wellhead 10 is configured to extract oil or gas, but other embodiments may be configured to extract other materials, such as water. Furthermore, some embodiments may be configured to inject materials, such as steam, carbon dioxide, or various other chemicals. Below, several devices and processes configured to isolate fluid pressure within the wellhead 10 are described. Before introducing these devices and processes, the wellhead 10 is described with reference to FIGS. 1 and 2.

The illustrated wellhead 10 includes a tree 12, an adapter flange 14, a tubing head 16, a surface casing 18, an intermediate casing 20, and a production casing 22. The tree 12 includes a plurality of valves that control fluid flow to or from the production casing 22. The tree 12 also includes an inlet 24 through which subsequently-described equipment is lowered into the wellhead 10. The adapter flange 14 is disposed between the tree 12 and the tubing head 16 and secures these components 12 and 16 to one another. The tubing head 16 includes a flange 26, lockdown pins 28, side valves 30 and 32, and pressure gauges 34 and 36.

Figure 2:
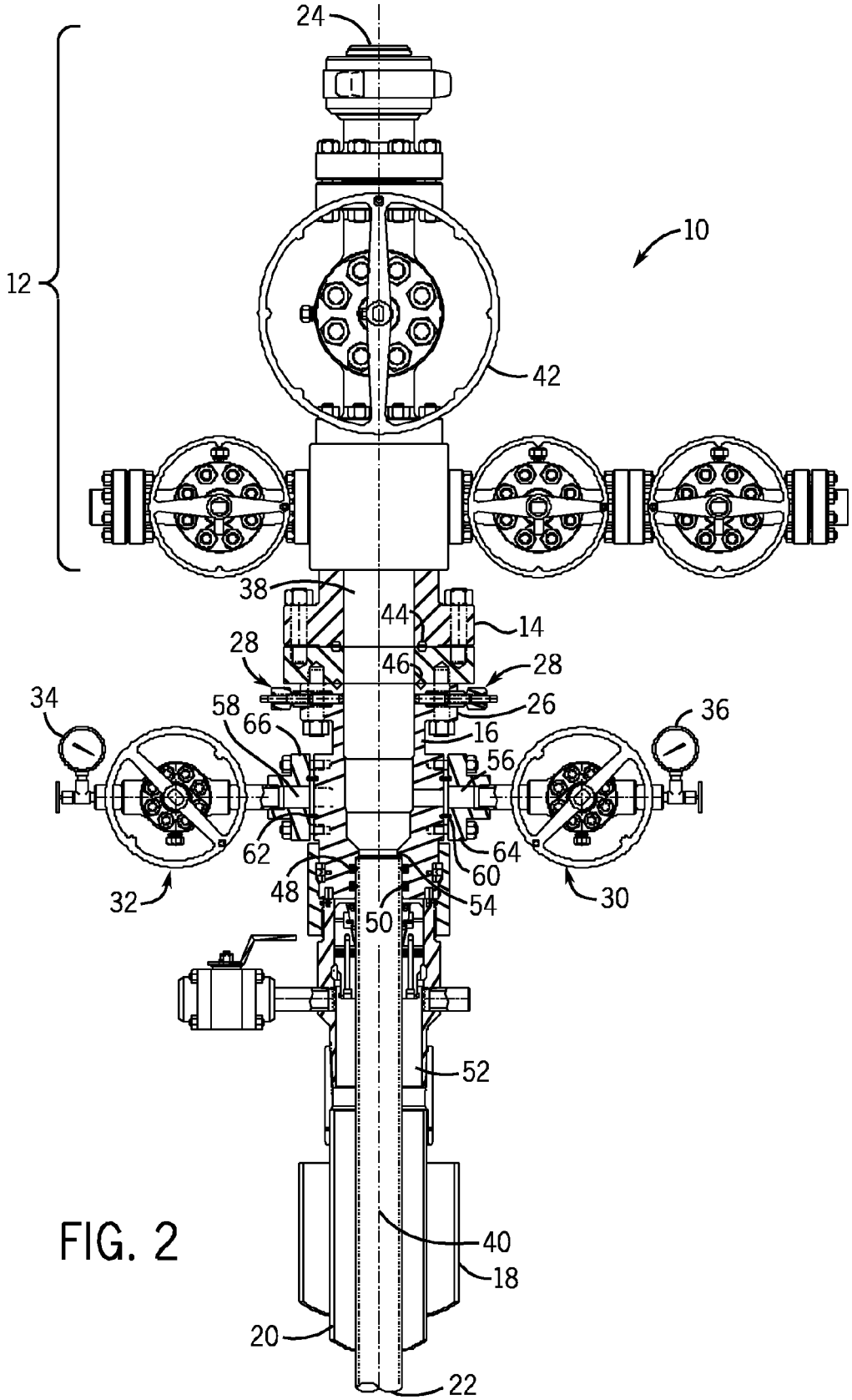
FIG. 2 is a cross-sectional side view of the wellhead of FIG. 1.

FIG. 2 illustrates a cross-sectional side view of the embodiment of a wellhead 10. The wellhead 10 defines a central passage 38 that connects to the production casing 22. In this embodiment, the central passage 38 is generally concentric about (or coaxial with) a central axis 40. The central passage 38 extends through a master valve 42 in the tree 12 to the inlet 24. However, it should be noted that the present invention is equally applicable to horizontal tree wellheads, in which the master production valve is positioned as a lateral branch, generally perpendicular to the central passage 38. Annular seals 44, 46, 48, and 50 seal the central passage 38 and the production casing 22. A casing hanger 52 carries the production casing 22, and a distal portion 54 of the production casing 22 extends into the tubing head 16. Side passages 56 and 58 extend generally radially outward from the central passage 38 to the side valves 30 and 32, respectively. The side passages 56 and 58 can provide access to casing regions when the production tubing is in place, for instance. Generally, annular seals 60 and 62 seal flanges 64 and 66 of the side valves 30 and 32 to the tubing head 16.

Figure 3:
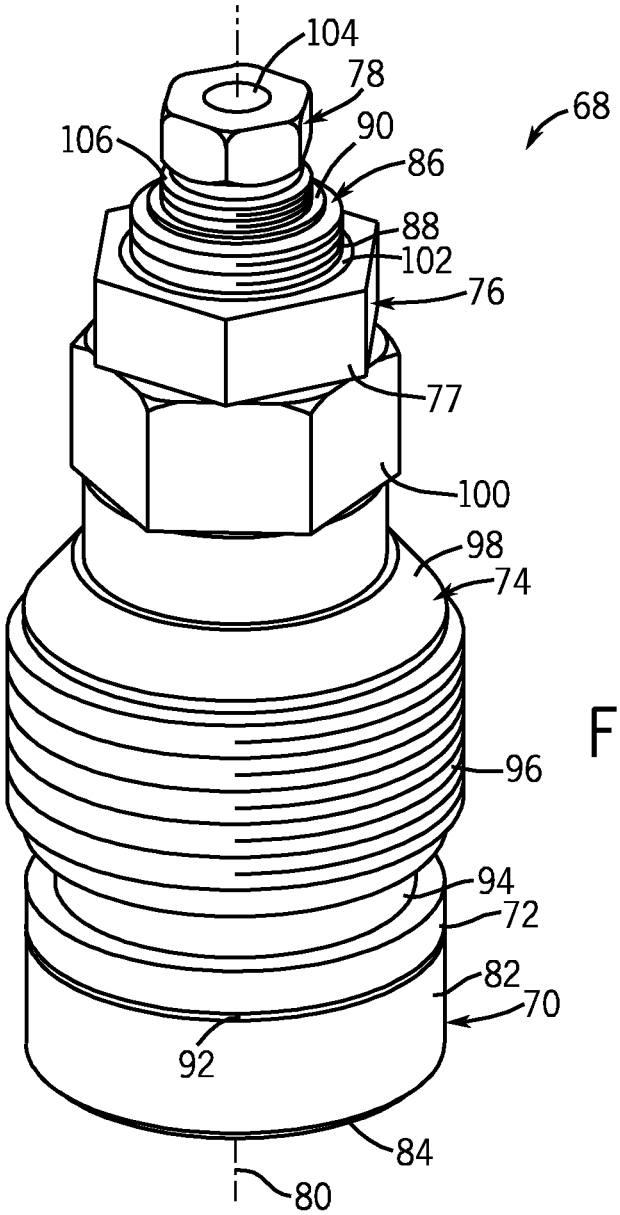
FIG. 3 is a perspective view of an example of a side plug that may be used with the wellhead of FIG. 1 in accordance with embodiments of the present technique.

When fracing the well coupled to the wellhead 10, the fluid pressure in the central passage 38 may be elevated above the pressure rating of the side valves 30 or 32. Accordingly, to protect the side valves 30 and 32 from this pressure, the side valves 30 and 32 may be temporarily sealed from the central passage 38 during fracing. FIG. 3 is a perspective view of an embodiment of a side plug 68 that may be used to seal the side passages 56 and 58.

Figure 4:
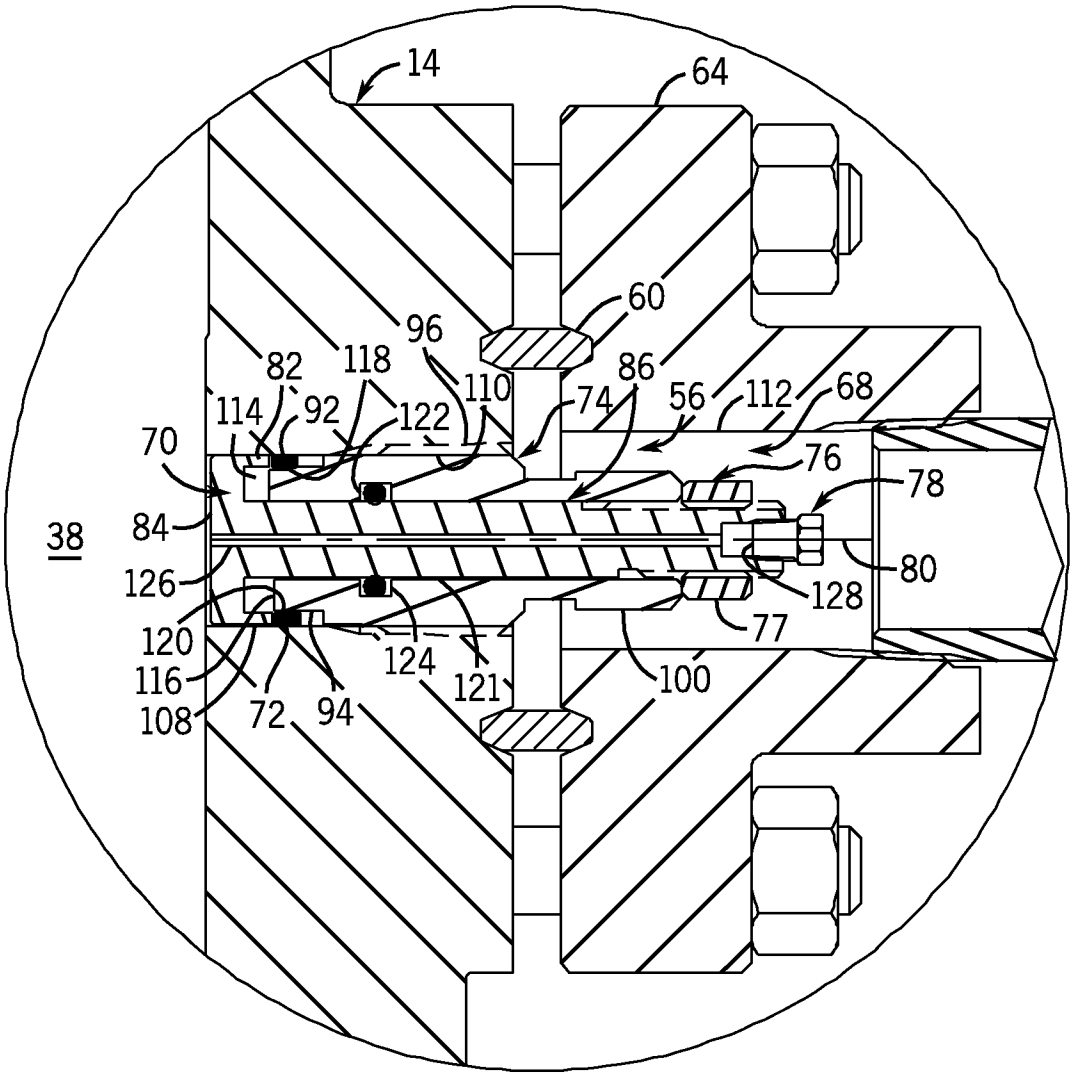
FIGS. 4 and 5 are cross-sectional side views illustrating installation of the side plug of FIG. 3 in the wellhead of FIG. 1.

As illustrated by FIGS. 3 and 4, the side plug 68 may include an inner member 70, a seal 72, an outer member 74, a seal actuator 76, and a valve 78. The components of the side plug 68 are generally concentric about (or coaxial with) an axis 80. The inner member 70 includes an annular flange 82, a generally circular plate 84, and a shaft 86 having external threads 88 and internal threads 90. As explained below with reference to the cross-section views provided in FIG. 4 and FIG. 5, the shaft 86 extends through the outer member 74 and couples to the seal actuator 76 and the valve 78 via external threads 90 and mating threads on each of these components 76 and 78. The generally tubular flange 70 is generally concentric with and overlaps the shaft 86 (this relationship is described further below with reference to FIGS. 4 and 5). A contact surface 92 may be generally orthogonal to the central axis 80 and may be shaped to apply a generally uniform axial force to the seal 72 along the central axis 80 as the inner member 70 is moved axially relative to the outer member 74. The inner member 70 may be made of or include steel or other appropriate materials.

In this embodiment, the seal 72 has a generally annular shape and is generally concentric about the central axis 80. The seal 72 may be made of or include an elastomer or other appropriate materials. Then seal 72 is adjacent the contact surface 92 and is disposed around both the shaft 86 of the inner member 70 and the outer member 74.

The illustrated outer member 74 includes a seal-expansion shelf 94, external threads 96, a chamfer 98, and a tool interface 100. The seal-expansion shelf 94 may define a generally right circular-cylindrical volume with a diameter selected to form an interference fit with the seal 72 when the seal 72 is shifted axially along the axis 80 by the inner member 70, as explained below. In this embodiment, the recessed portion, or inner diameter, of the threads 96 is larger than an outer diameter of the seal 72 to protect the seal 72 from complementary threads on the tubing head 16. The tool interface 100 has a generally hexagonal exterior cross-section, but in other embodiments, other tool interfaces configured to transfer torque or force to the outer member 74 may be used. The outer member 74 also includes an inner passage through which the inner member 70 extends and is generally free to slide, subject to boundaries defined by the circular plate 84 and the seal actuator 76. The outer member 74 may be made of steel or other appropriate materials.

The seal actuator 76 has a cross-section with a generally hexagon outer perimeter and is configured to interface with and receive torque from another tool. The seal actuator 76 includes interior threads 102 configured to mate with the threads 88 on the shaft 86. In some embodiments, to reduce the likelihood of the seal actuator 76 obstructing a tool interfacing with the tool interface 100, the widest outer diameter of the seal actuator 76 may be narrower than the narrowest outer diameter of the tool interface 100. That is, the seal actuator 76 may be configured to allow a tool to overlap the seal actuator 76 and reach the tool interface 100.

The valve 78 may be a check valve, e.g., a valve configured to open in response to a difference in fluid pressure across the valve, such as a positive fluid pressure greater than some threshold, and configured to close in response to a negative fluid pressure or a fluid press less than the threshold. For example, the valve 78 may be configured to open in response to higher pressure at an inlet 104 of the valve 78 relative to pressure at an outlet and to close in response to lower pressure at the inlet 104 relative to the outlet. In some embodiments, the valve 78 may include a ball that obstructs a passage to the inlet 104. The ball may be biased against this passage by a spring or other resilient member. In some embodiments, the valve 78 may be configured to open in response to a stimulus other than just a difference in fluid pressure. For example, the valve 78 may be opened by inserting a tool through the inlet 104 and dislodging a ball or other seal member that seals a passage to the inlet 104. Thus, in some embodiments, the valve 78 may allow fluid flow in through the inlet 104 under two conditions: when the pressure is higher at the inlet 104 than at the outlet, or in response to a tool being inserted through the inlet 104 and biasing a valve member, such as the ball mentioned above. The difference in the direction of flow, though, may be opposite under these two conditions, e.g., a pressure difference may trigger flow in one direction, and mechanically inserting a tool into the inlet 104 may allow flow in the opposite direction. External threads 106 on the valve 78 may be engaged with the internal threads 90 on the inner member 70. In other embodiments, the valve 78 may be secured to the inner member 70 with other mechanisms, e.g., they may be welded or integrally formed. Further, some embodiments may not include the valve 78, and the end of the shaft 86 may be sealed, which is not to suggest that any other feature described herein may not also be omitted.

FIG. 4 is a cross-sectional side view that illustrates the embodiment of the side plug 68 disposed in the side passage 56. The axis 80 may be generally perpendicular to the central axis 40 and may intersect the central axis 40. In this embodiment, the side passage 56 includes a narrower portion 108, a wider threaded portion 110, and an even wider portion 112 that extends to the side valve 30. The threaded portion 110 mates with the external threads 96 on the outer member 74. The narrower portion 108 is adjacent the central passage 38 and has a generally right circular-cylindrical shape that is generally concentric about the axis 80.

Before describing the operation of the side plug 68, various features of the side plug 68 that are illustrated by the cross-section view of FIG. 4 should be noted. As illustrated, the annular flange 82 of the inner member 70 defines a generally annular volume 114 that is shaped to receive a distal portion 116 of the outer member 74. The distal portion 116 includes the seal-expansion shelf 94 mentioned above, a frustoconical portion 118, and a relaxed-seal shelf 120. The relaxed-seal shelf 120 and the seal-expansion shelf 94 may define generally right circular-cylindrical volumes that are generally concentric about (or coaxial with) the central axis 80. In this embodiment, the diameter of the seal-expansion shelf 94 is larger than the diameter of the relaxed-seal shelf 120. The frustoconical portion 118 connects the shelves 94 and 120 and is also generally concentric about (or coaxial with) the central axis 80. The seal 72 may have a cross-sectional shape that is generally convex, e.g., the inner diameter surface may be sloped or curved radially inward toward the axis 80 and the other surfaces are generally flat.

The outer member 74 may include a passage 121 through which the shaft 86 extends, and a groove 122 that houses an O-ring seal 124. The O-ring seal 124 may be an elastomer that seals between the shaft 86 of the inner member 70 and the groove 122 of the outer member 74. Also illustrated by FIG. 4 is a passage 126 through the shaft 86 of the inner member 70. The passage 126 may be a generally right circular-cylindrical volume that is generally concentric about (or coaxial with) the central axis 80. The passage 126 extends between the circular plate 84 and an outlet 128 of the valve 78, placing the outlet 128 of the valve 78 in fluid communication with the central passage 38 of the wellhead 10 (FIG. 2). In other embodiments, the plug 68 may not include the passage 126 or the valve 78, and the plug 68 may be configured to obstruct fluid flow through the side passage 56 in both directions, regardless of fluid pressure.

In this embodiment, the side plug 68 seals the side passage 56 with two steps. First, as illustrated by FIG. 4, the outer member 74 engages the tubing head 16. To this end, a tool couples to the tool interface 100 and rotates the outer member 74 to engage the threads 96 on the outer member 74 with the threads 110 in the side passage 56. In other embodiments, the outer member 74 may be coupled to the tubing head 16 or other portion of the wellhead 10 (FIG. 2) with other coupling mechanisms, such as a lock ring that engages an annular groove in the tubing head 16 or lockdown pins that extended from the tubing head 16 to engage a groove in the outer member 74.

Figure 5:
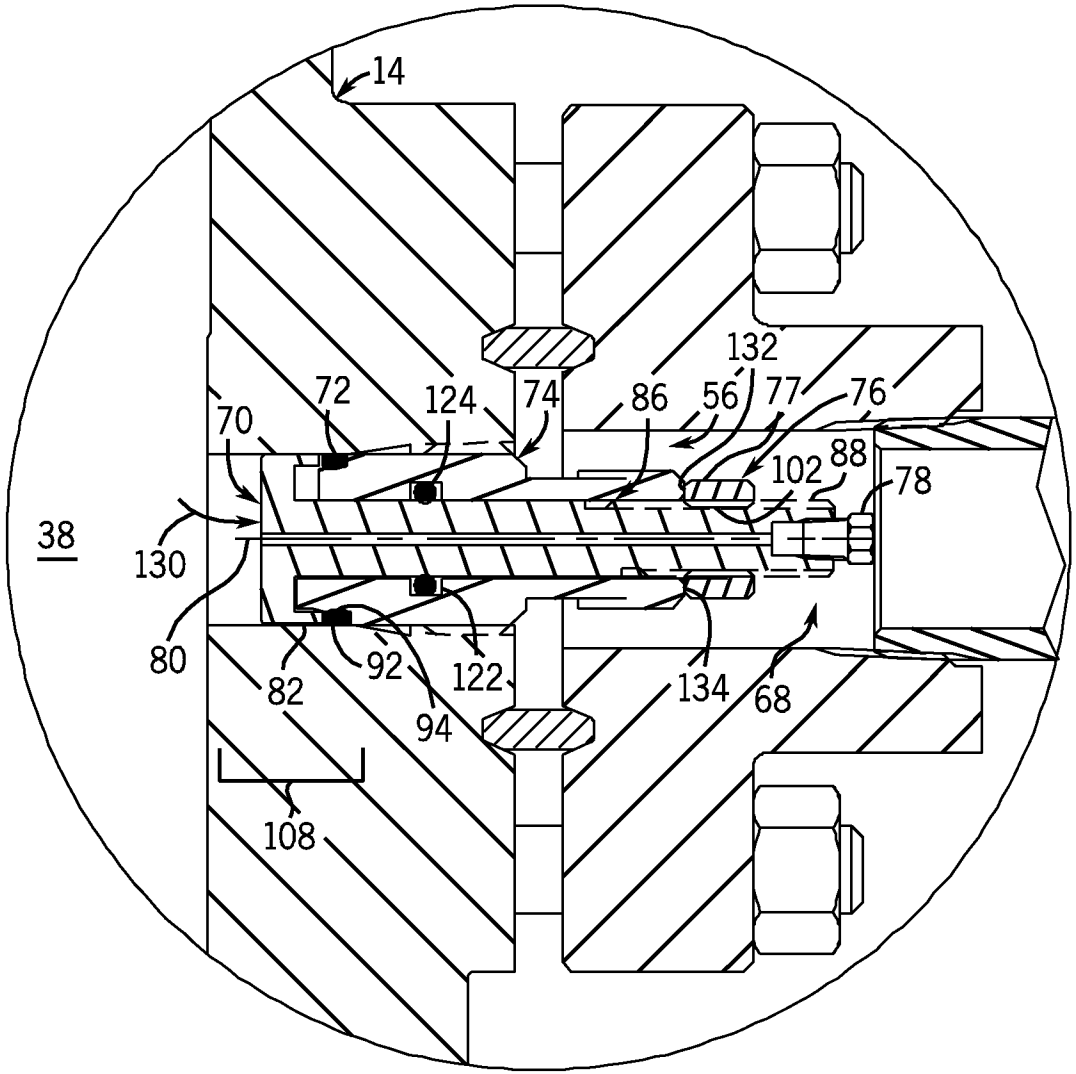

FIG. 5 illustrates the next step for sealing the side passage 56 with the side plug 68. A different tool, or a different portion of the same tool, engages the tool interface 77 on the seal actuator 76. The seal actuator 76 is then rotated independent of the inner member 70. As the seal actuator 76 is rotated about this shaft 86, the threads 88 and 102 cooperate to axially bias a bottom surface 132 of the seal actuator 76 against a top surface 134 of the outer member 74 and, as a result, pull the inner member 70 through the outer member 74, as illustrated by arrow 130. The inner member 70 may be characterized as having one degree of freedom of movement relative to the outer member 74. The axial movement 130 of the inner member 70 axially biases the seal 72 through the contact surface 92 of the annular flange 82, and the seal 72 is pushed over the frustoconical portion 118 of the outer member 74 and onto the seal-expansion shelf 94. Moving the seal 72 onto the seal-expansion shelf 94 radially expands the seal 72 and compresses the seal 72 axially and radially between the surface of the narrow portion 108 of the side passage 56 and the seal-expansion shelf 94, thereby forming a relatively robust seal. Put differently, the seal 72 is compressed, thereby decreasing the seal's lateral dimensions but biasing the seal outward in the radial or vertical direction. In some embodiments, the seal formed by these components may be configured to withstand pressures greater than 5000 psi, 7500 psi, or 10,000 psi in the central passage 38.

The O-ring seal 124 seals the path through the passage 121 by sealing against the groove 122 and the outer surface of the shaft 86. In some embodiments, friction between the O-ring seal 124 and the outer shaft 86 may impede the inner member 70 from rotating with the seal actuator 76, but in some embodiments, the side plug 68 may include other structures configured to impede rotation of the inner member 70 relative to the seal actuator 76 while the seal actuator 76 is rotated. For example, the outer member 74 may include a generally axial slot and the shaft 86 may include a guide pin that extends into and slides through the slot.

In other embodiments, the side plug 68 may be formed with an inner member 70 and an outer member 74 that do not move relative to one another. For example, the side plug 68 may include a one-piece body, an example of which is described below with reference to FIG. 16.

Figure 6:
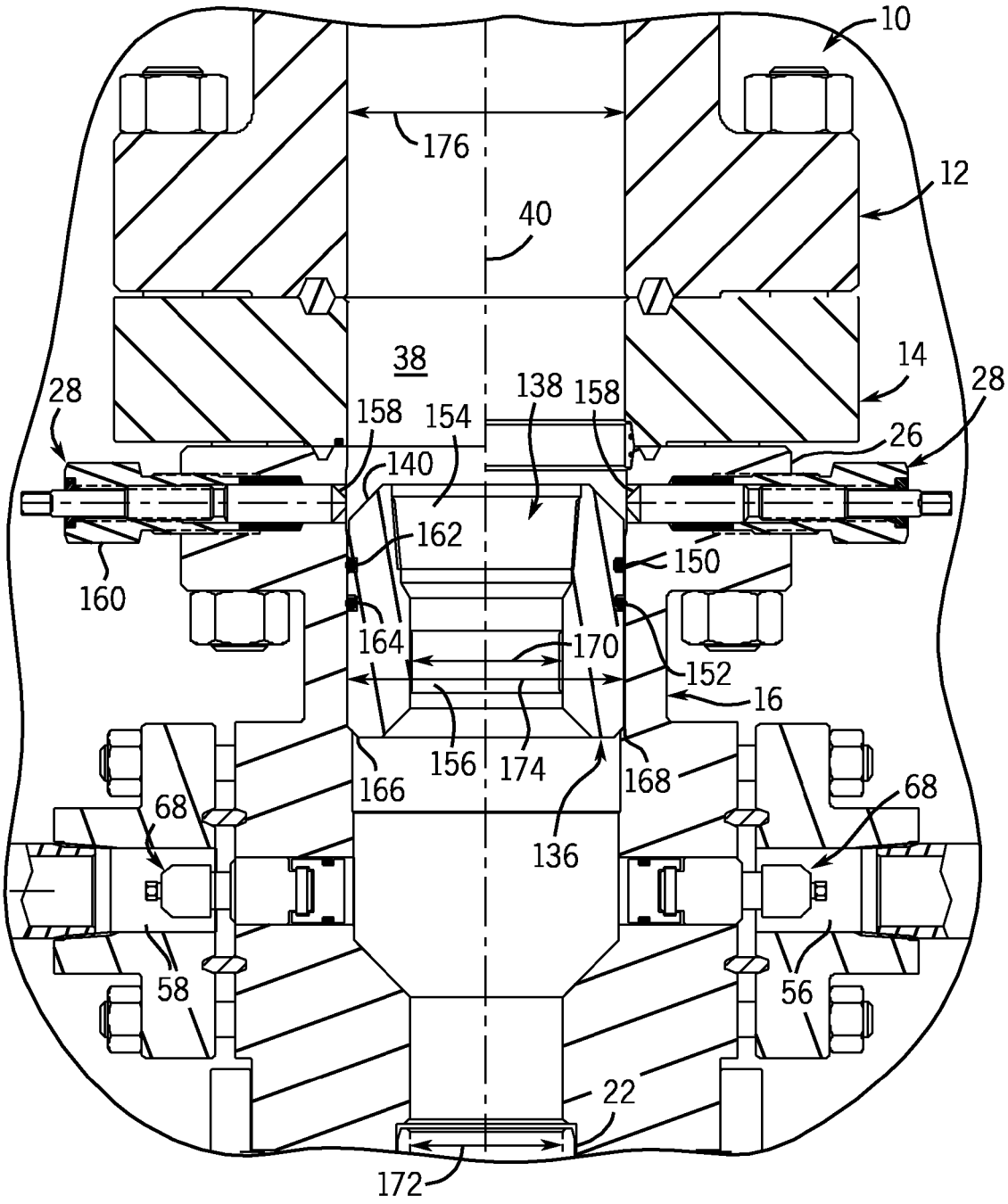
FIG. 6 is a cross-sectional side view of the side plug and a pressure-barrier hanger installed in the wellhead of FIG. 1.

FIG. 6 is a cross-sectional side view of the embodiment of the wellhead assembly 10 being prepared for fracing. In this embodiment, a side plug 68 is installed in each of the side passages 56 and 58, and a pressure-barrier hanger 136 is disposed in the central passage 38. As explained below, the pressure-barrier hanger 136 may support a pressure barrier that temporarily obstructs the central passage 38 while various equipment, such as a frac tree, the tree 12, or a blowout preventer, is connected to the tubing head 16. In this embodiment, the pressure-barrier hanger 136 is made of steel and is generally concentric about the central axis 40. The pressure-barrier hanger 136 may include an inner passage 138, a hanger-restraint interface 140, and seals 150 and 152.

The inner passage 138 includes an interface 154, such as internal threads, for coupling to a tool that lowers the pressure-barrier hanger 136 through the central passage 38. The inner passage 138 may also include a pressure-barrier interface 156, such as internal threads, for securing a pressure barrier. In some embodiments, the pressure barrier may be a solid member that obstructs the central passage 38 or it may include a check valve configured to obstruct fluid flowing axially upward through the central passage 38 while allowing fluid to flow actually downward through the central passage 38.

The hanger-restraint interface 140, in this embodiment, is a generally chamfered surface of the pressure-barrier hanger 136 that defines a generally frustoconical volume that is generally concentric about the central axis 40. The illustrated hanger-restraint interface 140 mates with a generally frustoconical distal portion 158 of the locking pins 28, and locking pins 28 are typically provided in tubing heads to compress and maintain tubing hangers suspending the tubing head, for instance. To engage these components 158 and 140, a bushing 160 of the locking pin 28 is rotated to drive the distal portion 158 radially inward into engagement with the hanger-restraint interface 140. In other embodiments, the hanger-restraint interface 140 may include other structures configured to secure the pressure-barrier hanger 136 in the central passage 38. For example, the hanger-restraint interface 140 may include a groove or indentation in the side of the pressure-barrier hanger 136 that is configured to receive the distal portion 158, or the hanger-restraint interface 140 may include threads or a lock ring to mate with complementary structures on the wellhead 10.

The seals 150 and 152 may be elastomer O-ring seals disposed in grooves 162 and 164 around the pressure-barrier hanger 136. The pressure-barrier hanger 136 may also include a bottom chamfer 166 shaped to rest on a shoulder 168 inside the tubing head 16 and axially align the pressure-barrier hanger 136 with the locking pins 28.

The illustrated pressure-barrier hanger 136 does not overlap or seal the side passages 56 or 58, because the side passages 56 and 58 are sealed with the side plugs 68. In other embodiments, the pressure-barrier hanger 136 may extend over these passages 56 and 58 and seal these passages 56 and 58, either supplementing the side plugs 68 or sealing the passages 56 and 58 without the side plugs 68. In the illustrated embodiment, the pressure-barrier hanger 136 does not extend substantially above the flange 26 of the tubing head 16 into the adapter flange 14. In other embodiments, the pressure-barrier hanger 136 may extend into the adapter flange 14 or through the adapter flange 14. Moreover, the pressure-barrier hanger 136 may be modified to support production tubing, for instance.

The pressure-barrier hanger 136 may have a minimum inner diameter 170 that is generally equal to or larger than an inner diameter 172 of the production casing 22. As a result, in some embodiments, the pressure-barrier hanger 136 may be referred to as a full-bore pressure-barrier hanger. Having a minimum diameter 170 generally equal to or larger than the diameter 172 of the production casing 22 is believed to facilitate fluid flow into the production casing 22 when fracing the well and the insertion or removal of down-hole tools, but, in other embodiments, the diameter 170 may be smaller than the diameter 172.

The pressure-barrier hanger 136 may also have a maximum outer diameter 174 that is generally equal to or less than a diameter 176 of components disposed above the tubing head 16. Having a maximum outer diameter 174 that is generally equal to or less than the diameter 176 is believed to facilitate removal of the pressure-barrier hanger 136 through the central passage 38 of various components connected to the tubing head 16, such as a blowout preventer, the adapter flange 14, the tree 12, or a frac tree. In other embodiments, though, the maximum outer diameter 174 may be larger than the diameter 176, and the components disposed above the tubing head 16 may be removed to access the pressure-barrier hanger 136.

Figure 7:
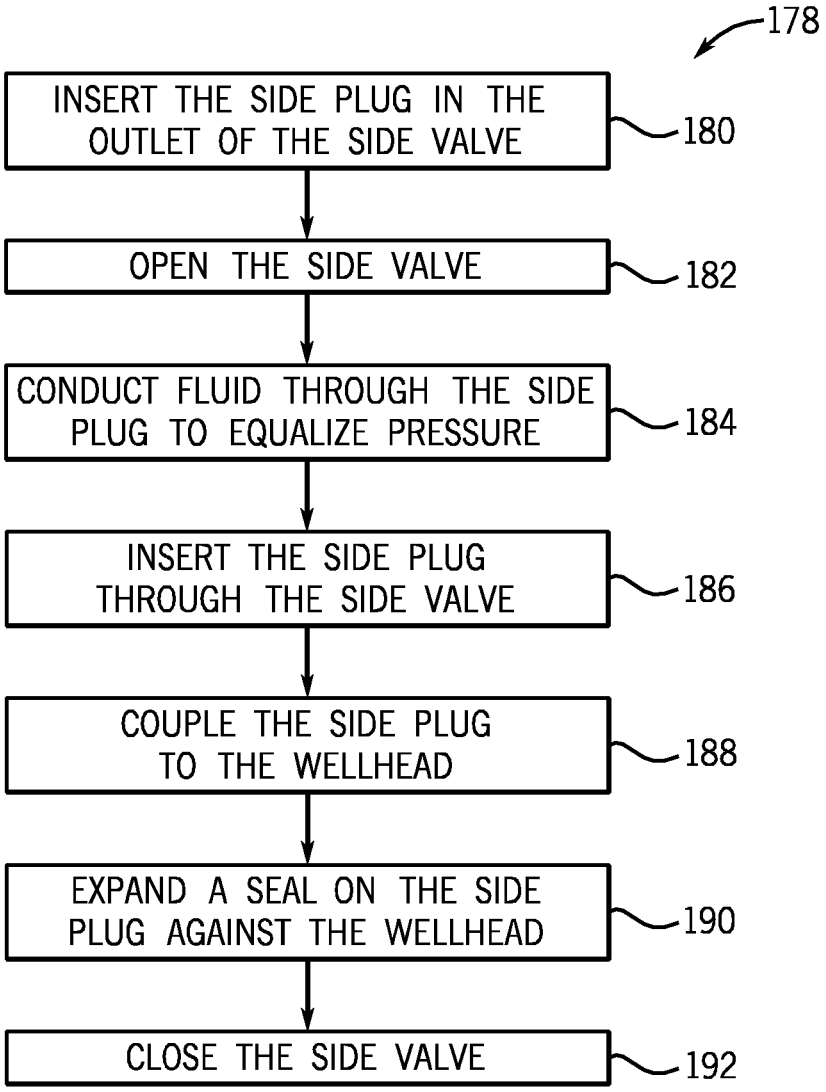
FIG. 7 is a flow chart depicting an example of a process for installing the side plug of FIG. 3 in a pressurized wellhead in accordance with embodiments of the present technique.

In some situations, it may be useful to install the side plug 68 while the central passage 38 is under pressure, e.g., if the side plug 68 is installed after the pressure barrier and the pressure-barrier hanger 136. FIG. 7 is a flow chart of an embodiment of a process 178 for installing the side plug 68 in a side passage 56 or 58 that is pressurized. The process 176 begins with inserting the side plug in the outlet of the side valve 30 or 32, as illustrated by block 180. This step may include removing the pressure gauges 34 and 36 (FIG. 2) and connecting a tool, such as a side lubricator, to the outlet of the side valve 30 or 32. Next, the side valve 30 or 32 is opened, as illustrated by the block 182. Opening the side valve 30 or 32 places the side plug 68 in fluid communication with the pressurized central passage 38 (FIG. 2). Next, fluid is conducted through the side plug 68 to equalize pressure on either side of the side plug 68. Conducting fluid through the side plug may include actuating the valve 78 (FIG. 3) by inserting a member through the inlet 104 and dislodging a valve member, such as a ball. Fluid may flow through the passage 126 and the valve 78 to equalize pressure on either side of the side plug 68. Equalizing pressure is believed to reduce the hydraulic or pneumatic forces counteracting movement of the side plug 68 into the passage 56 or 58. In this embodiment, the side plug 68 may then be inserted through the side valve 30 or 32 and through side passages 56 or 58, as illustrated by block 186. The side plug 68 is then coupled to the wellhead 16 by a rotating the tool interface 100 and engaging the threads 96 with the threads 110 (FIG. 4), as illustrated by block 188. Next, the seal 72 on the side plug 68 is expanded by rotating the seal actuator 76 about the shaft 86 and driving the seal 72 onto this seal-expansion shelf 94, as illustrated by block 190. Finally, the side valve 30 or 32 is closed, as illustrated by block 192.

Figure 8:
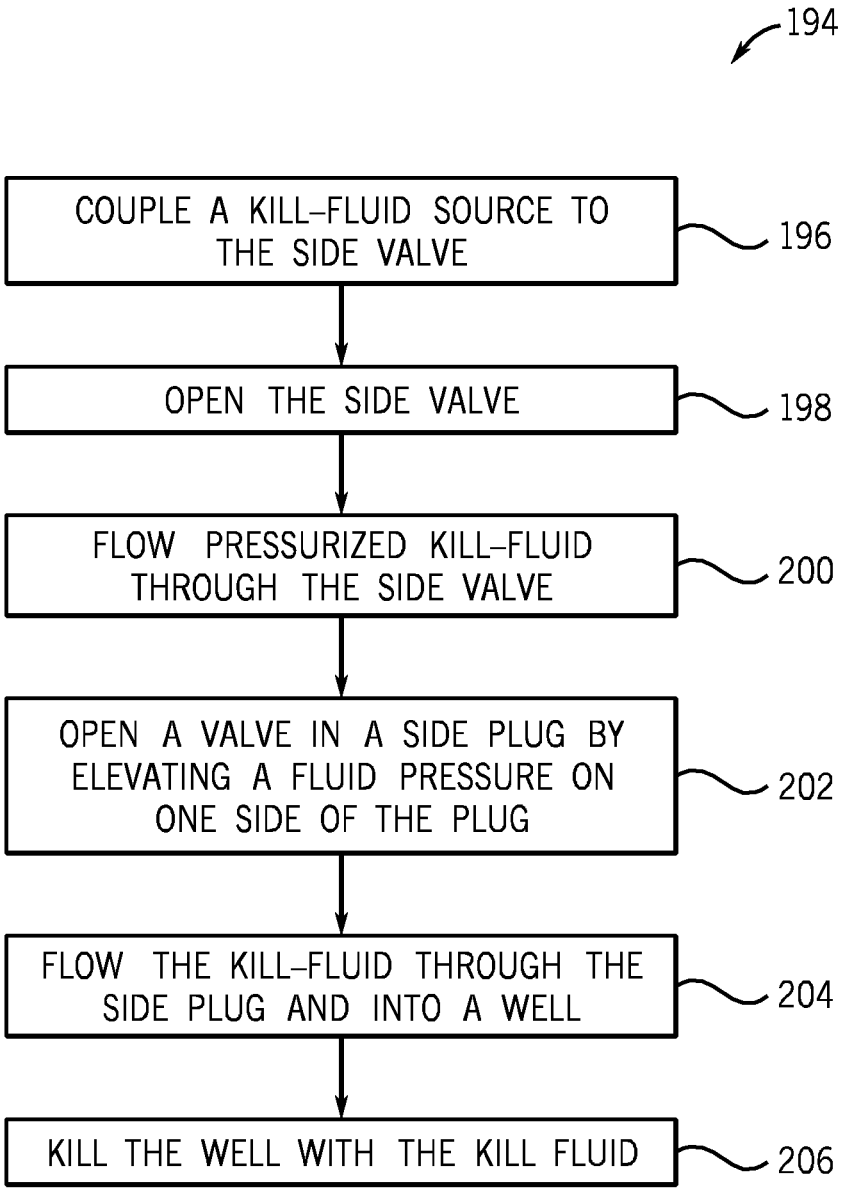
FIG. 8 is a flow chart depicting an example of a process for killing a well by conducting a fluid through the side plug of FIG. 3 in accordance with embodiments of the present technique.

FIG. 8 is a flow chart of an embodiment of a process 194 for killing a well by conducting fluid through the side plug 68. The phrase "killing a well" refers to the process of obstructing the well with fluid that counteracts and contains the fluid pressure in the well. For example, the hydrostatic pressure applied by the inserted fluid or "mud" is greater than the natural wellbore pressure. The process 194 begins with coupling a kill-fluid source to the side valve 30 or 32, as illustrated by block 196. Examples of kill fluid include mud or other fluids selected to counteract down-hole pressure. Next, the side valve 30 or 32 is opened, as illustrated by block 198, and kill fluid is pumped through the side valve 30 or 32, as illustrated by block 200. In some embodiments, the kill fluid may be pressurized to a pressure that is greater than the pressure in the central passage 38 (FIG. 2). This pressure difference may open the valve 78, e.g., by dislodging a seal member, such as a ball, biased against a passage through the valve 78, as illustrated by block 202. The kill fluid then flows through the side plug 68 and into the production casing 22, as illustrated by block 204. In some embodiments, the kill fluid may be pressurized to a pressure that is greater than 5000 psi or 10,000 psi. Also, in some embodiments, the pressure barrier may be installed in the pressure-barrier hanger 136 during the execution of the process 194. Finally, the well is killed with the kill fluid, as illustrated by block 206.

Figure 9:
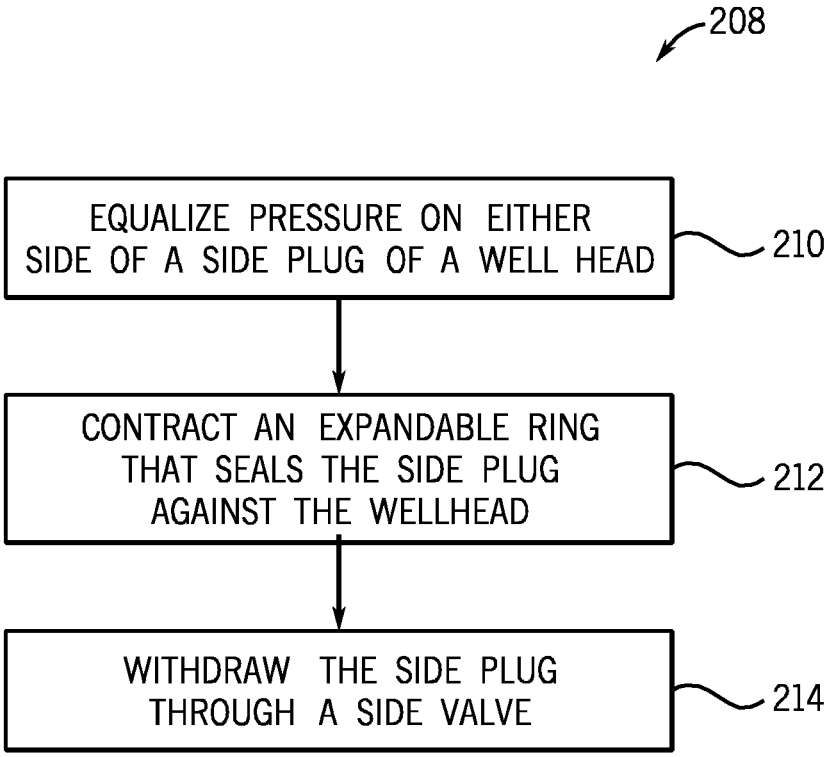
FIG. 9 is a flow chart depicting an example of a process for removing the side plug of FIG. 3 from a wellhead under pressure in accordance with embodiments of the present technique.

FIG. 9 illustrates a process 208 for withdrawing the side plug 68 under pressure. The process 208 begins with equalizing pressure on either side of the side plug, as illustrated by block 210. As mentioned above, equalizing pressure on either side of the side plug 68 may include inserting a member through the inlet 104 (FIG. 3) and dislodging a valve member. As the valve member is dislodged, fluid may flow through the side plug 68 and equalize pressure on either size of the side plug 68. Equalizing pressure is believed to reduce the pneumatic forces applied to the side plug 68, reducing the likelihood of the side plug 68 being propelled by these forces and allowing the side plug 68 to be removed in a controlled manner. Next, the seal 72 may be contracted, as illustrated by block 212. Contracting the seal 72 may include rotating the seal actuator 76 to disengage the inner member 70 from the seal 72 and rotating the tool interface 100 to decouple the outer member 74 from the tubing head 16. As the side plug 68 translates radially (relative to the central axis 40—axially relative to the axis 80) away from the central passage 38, friction from the tubing head 16 pulls the seal 72 back to the relaxed-seal shelf 120, where the seal 72 can contract. Finally, the side plug 68 is withdrawn through the side valve 30 or 32, as illustrated by block 214.

Figure 10:
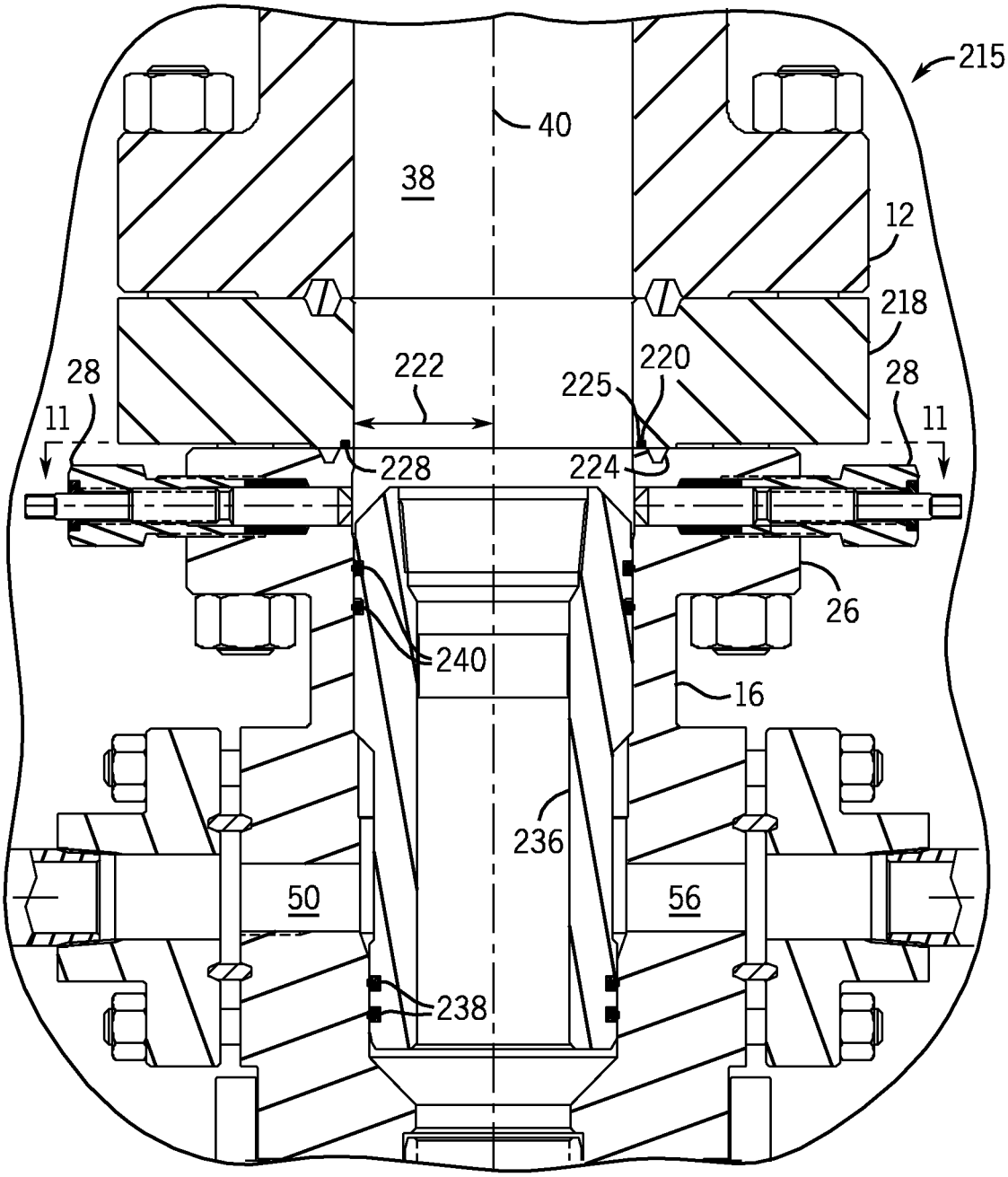
FIG. 10 illustrates an example of a seal configured to reduce axial stress in a wellhead in accordance with embodiments of the present technique.

While fracing a well, fluid pressure in the central passage 38 may create large forces in the wellhead 10. For example, with reference to FIG. 2, fluid pressure in the region between the adapter flange 14 and the flange 26 of the tubing head 16, within the area defined by the seal 46, generates relatively large axial forces, as the fluid pressure drives of these components 26 and 14 away from one another. FIG. 10 is a cross-sectional view of an embodiment of a wellhead 216 designed to reduce these axial loads as compared to some conventional designs. In this embodiment, the wellhead 216 includes an adapter 218 with a seal 220 disposed at a smaller radius 222 than a seal groove 224 specified by the American Petroleum Institute (API) standard for API flanges. The seal 220 is spaced radially inward from the seal groove 224 to reduce axial forces, as explained below with reference to FIG. 11. The illustrated seal 220 is an elastomer O-ring disposed in a groove 226. The illustrated groove 226 and the illustrated seal 220 are generally concentric about (or coaxial with) the central axis 40. The seal 220 seals against a generally flat surface 228 on the top of the flange 26 of the tubing head 16, adjacent to and at a smaller diameter than the API specified groove 224.

Figure 11:
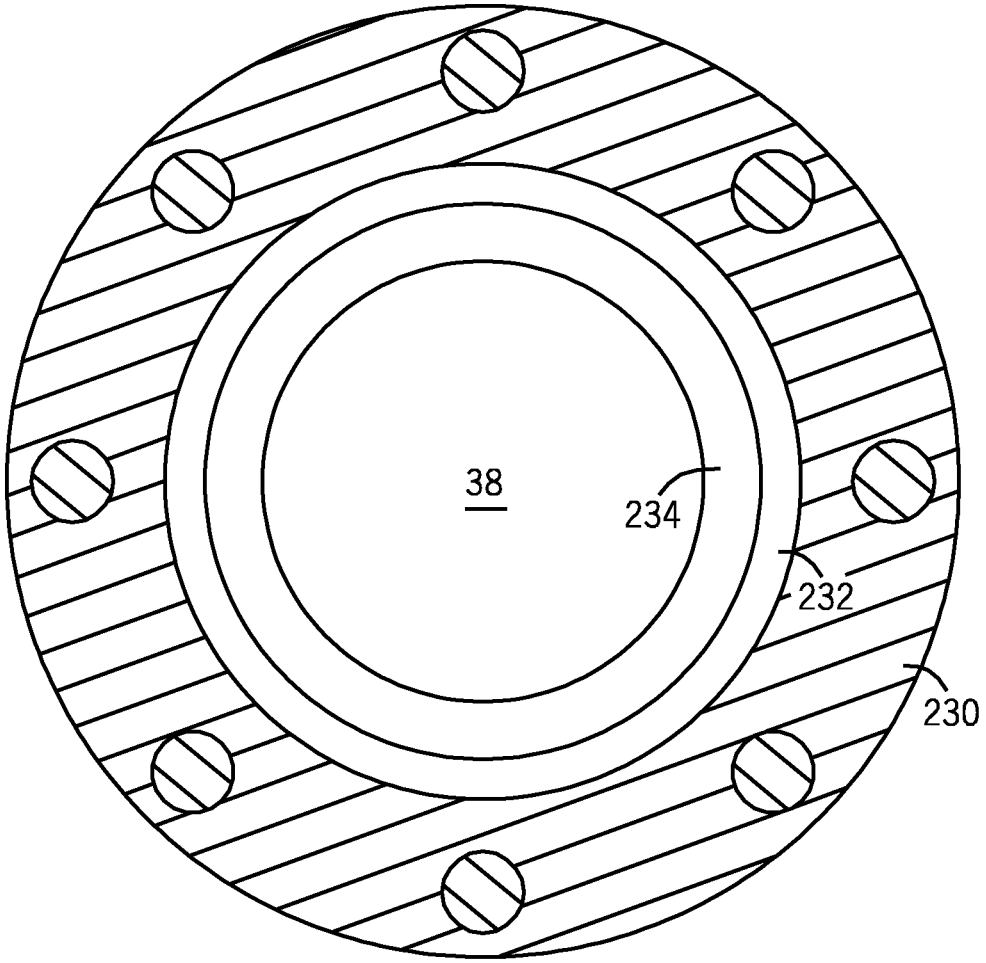
FIG. 11 is cross-sectional top view of the wellhead adjacent the seal of FIG. 10.

FIG. 11 is a top cross-section view that illustrates how the embodiment of the seal 220 reduces axial loads from fluid pressure in the central passage 38. FIG. 11 illustrates three annular zones 230, 232, and 234 of the flange 26. Zones 232 and 234 represent the surface area of the flange 26 that is exposed to the fluid pressure of the central passage 38 when a seal is formed only in the API specified groove 224. Zone 230 represents the area of the flange 26 that is not exposed to this pressure. The axial force established by the pressure in the central passage 38 is the product of the pressure and the area of zones 232 and 234. In contrast, zone 234 represents the surface area of the flange 26 that is exposed to pressure when the smaller-diameter seal 220 seals against the flange 26. Again, the axial force is the product of the surface area of zone 234 and the pressure in the central passage 38, but the surface area of zone 234 is smaller than the surface area of zones 232 and 234 combined. Accordingly, the axial forces arising from pressure in the central passage 38 is reduced with the seal 220.

Reducing the axial forces is believed to facilitate higher fracing pressures. For instance, a well coupled to the wellhead 10 may be fraced at pressures greater than 5,000 psi, 10,000 psi, or greater, without protecting the interface between the adapter 218 and the tubing head 16 with other structures, such as a sleeve disposed in the central passage 38. In some embodiments, these pressures may be achieved without increasing the size of the bolts securing the adapter 218 to the tubing head 16, but if needed, the size of the bolts may be increased to further strengthen this interface.

The seal 220 may be used in conjunction with the pressure-barrier hanger 136 and side plugs 68 described above with reference to FIG. 6, or the seal 220 may be used with the pressure-barrier hanger 236 illustrated by FIG. 10, for example. This pressure-barrier hanger 236 includes lower seals 238 that cooperate with seals 240 to seal the passages 56 and 58. Accordingly, in some embodiments, the pressure-barrier hanger 236 may be used without the side plugs 68 or with the side plugs 68.

Figure 12:
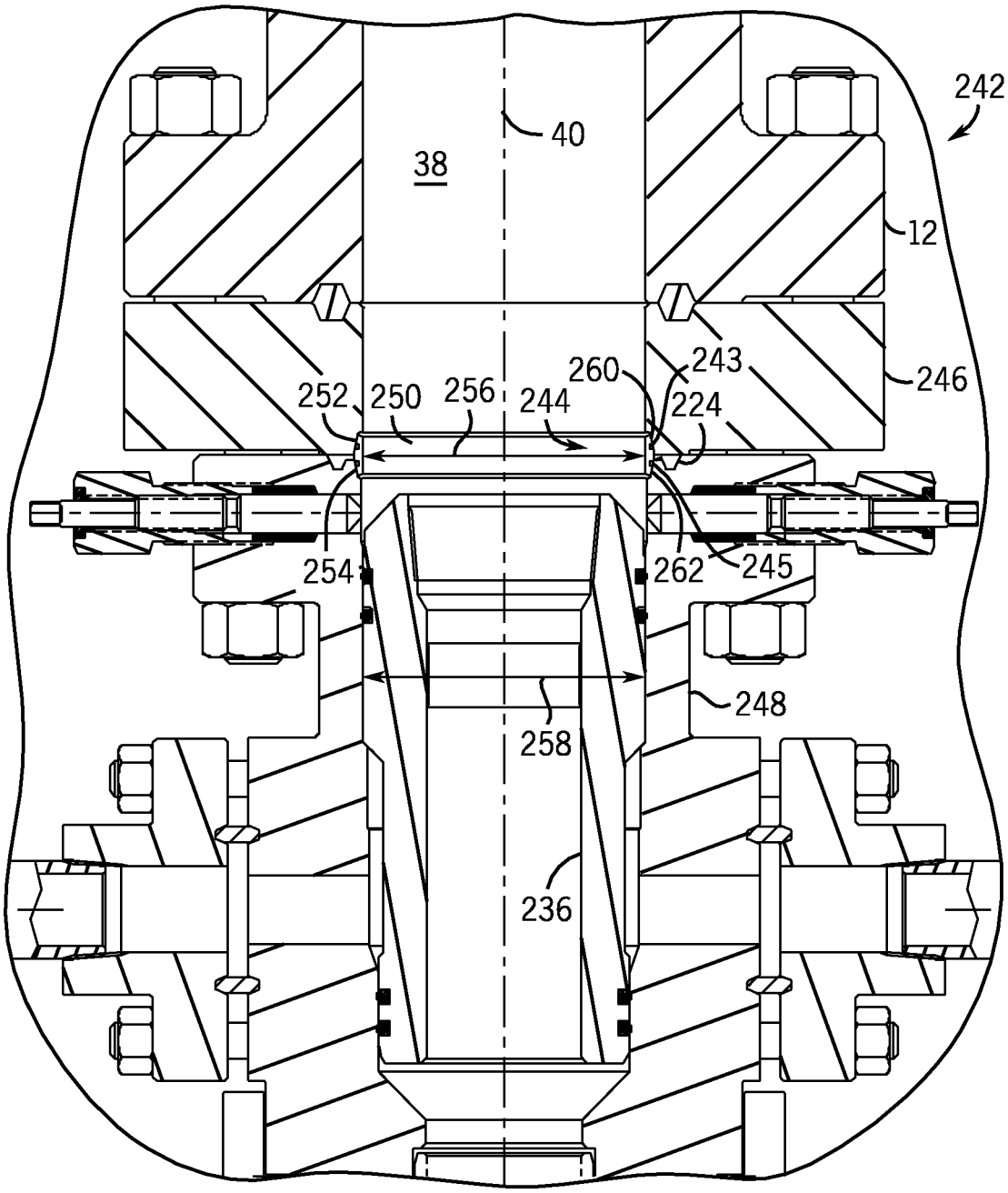
FIG. 12 is a cross-sectional side view of another example of a seal configured to reduce axial stress in a wellhead in accordance with embodiments of the present technique.

FIG. 12 is a cross-sectional side view of another embodiment of a wellhead 242 configured to reduce axial loads from fluid pressure. The wellhead 242 includes a seal ring 244 disposed in the central passage 38. The seal ring 244 may be made of metal, such as steel or brass, or other appropriate materials. In this embodiment, the seal ring 244 includes O-ring seals 243 and 245 disposed about an outer diameter of the seal ring 244, e.g., in annular grooves. In certain embodiments, the O-ring seals 243 and 245 may be elastomer seals. In other embodiments, the seal ring 244 may not include the O-ring seals 243 and 245. For instance, the seal ring 244 may form a metal-to-metal seal with an adapter 246 and a tubing head 248. The illustrated seal ring 244 is generally concentric about (or coaxial with) the central axis 40 and has an inner surface 250 that generally defines a right circular-cylindrical volume. In some embodiments, the inner surface 250 may define a diameter 256 that is generally equal to or greater than a largest outer diameter 258 of the pressure-barrier hanger 236. The outer surface includes an upper portion 252 and a lower portion 254 that each generally define frustoconical volumes that are oppositely oriented from one another. The outer diameter of the seal ring 244, in some embodiments, is smaller than the diameter of the API specified groove 224, reducing the area exposed to pressure.

The illustrated wellhead 242 includes the adapter 246 with an annular groove 260 that is generally complementary to the upper portion 252 of the outer surface of the seal ring 244. The wellhead 242 also includes the tubing head 248 with an annular groove 262 that is generally complementary to the lower portion 254 of the outer surface of the seal ring 244. The diameter of these annular grooves 260 and 262 may be sized to bias the seal ring 244 radially inward, e.g., with an interference fit. As with the previous embodiment, the illustrated seal ring 244 is believed to form a seal with a smaller radius than a seal formed by a seal member disposed in the groove 224. This is believed to reduce axial loads arising from fluid pressure in the central passage 38.

Figure 13:
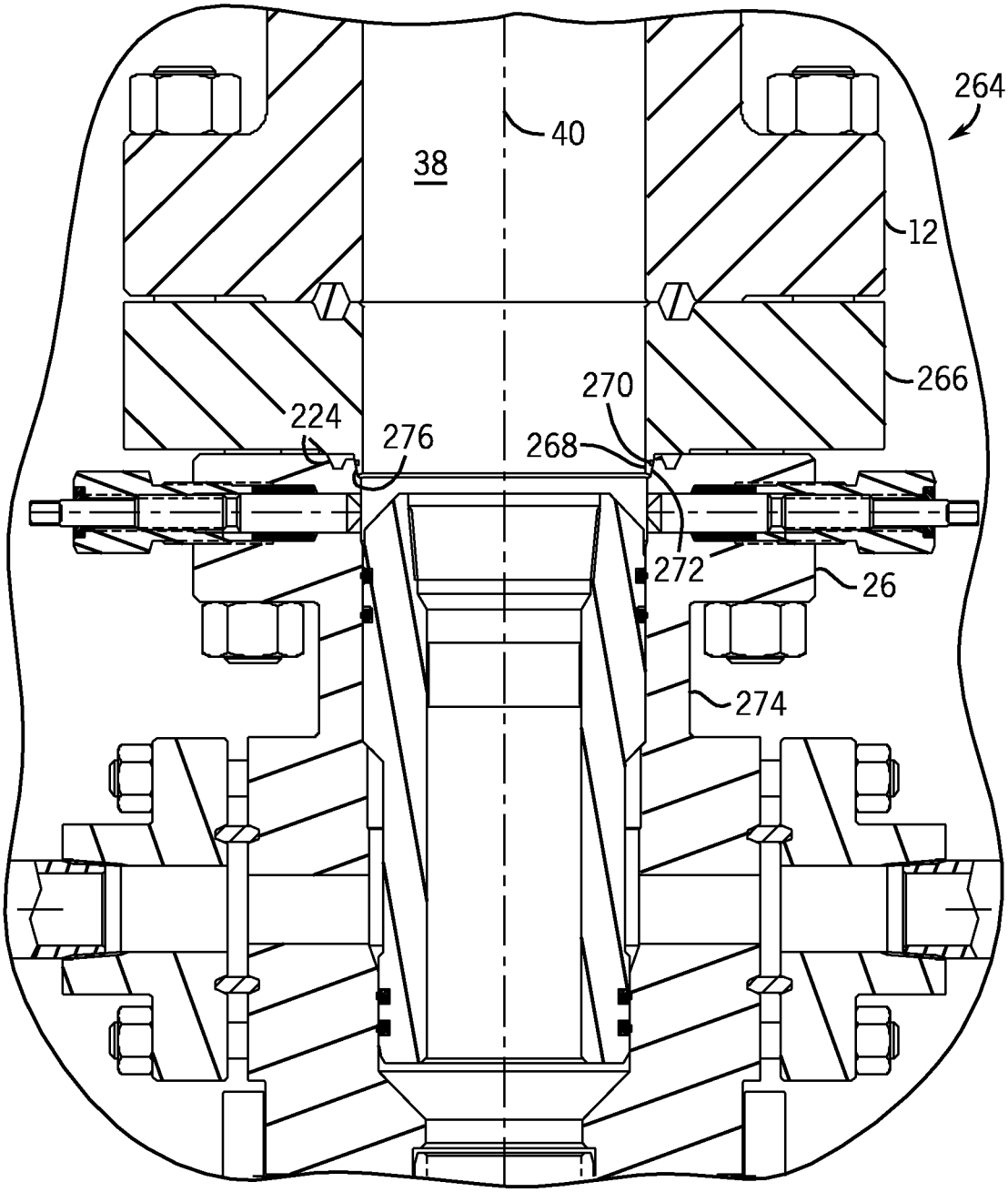
FIG. 13 is a cross-sectional side view of a third example of a seal configured to reduce axial stress in a wellhead in accordance with an embodiment of the present technique.

FIG. 13 is a cross-sectional view of another embodiment of a wellhead 264. In this embodiment, the wellhead 264 includes an adapter 266 with a flange 268 that supports a seal 270. The seal 270 may be an elastomer disposed in a groove in an outer surface of the flange 268. In other embodiments, the seal 270, like many of the other features described herein, may be omitted, and the flange 268 may form a metal-to-metal seal. The flange 268, in this embodiment, is generally concentric about (or coaxial with) the central axis 40 and has an outer surface 272 that is sloped to generally define a frustoconical volume. The flange 268 is generally disposed at a smaller diameter than the API specified groove 224. The wellhead 264 also includes a tubing head 274 configured to receive the adapter 266. The tubing head 274 includes a groove 276 that is generally complementary to the flange 268. The wellhead 264 is believed to form a seal with a smaller diameter than a seal formed by a seal member in the groove 224 and reduce axial loads arising from fluid pressure in the central passage 38. The longer pressure-barrier hanger 236 may isolate the side passages 56 and 58 with the lower elastomer seals 228 (FIG. 10) and upper elastomer seals 240, or the side plugs 68 described above may isolate the side passages 56 and 58. In other embodiments, the flange 268 may extend upward from the tubing head 274, and the adapter 266 may include the groove 276.

Figure 14:
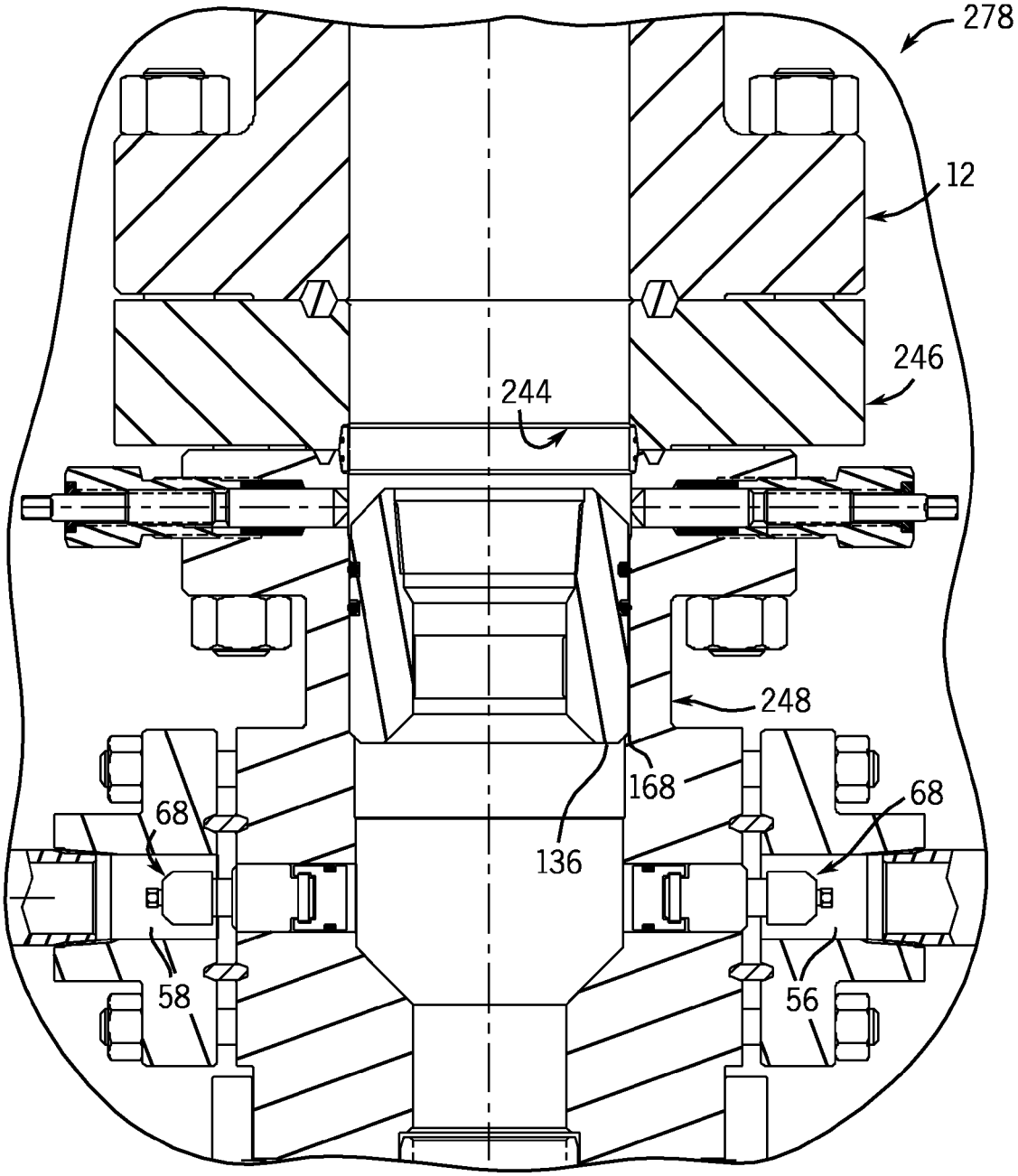
FIG. 14 is a cross-sectional side view of a wellhead with the side plug of FIG. 3, the valve hanger of FIG. 6, and the seal of FIG. 12 in accordance with embodiments of the present technique.

FIG. 14 is a cross-sectional view of the embodiment of the wellhead 278 with the seal ring 244, adapter 246, and tubing head 248 of FIG. 12 and the pressure-barrier hanger 136 and side plugs 68 of FIG. 6. As illustrated by this figure, each of the seals between the adapter and the tubing head, pressure-barrier hangers, and side plugs described above may be combined in various permutations. Combining the side plugs 68 with the seal ring 244 (or one of the other seals described above with reference to FIGS. 10-13) is believed to protect two of the areas of the wellhead 278 that are more sensitive to higher pressures during fracing. As a result, in some embodiments, a relatively short pressure-barrier hanger 136 may be used. As mentioned above, the illustrated pressure-barrier hanger 136 does not overlap either the junction between the adapter 246 and the tubing head 248 or the side passages 56 or 58. Indeed, in some embodiments, the wellhead 278 may receive frac pressures greater than 10,000 psi without sealing this junction or the passages 56 or 58 with the pressure-barrier hanger 136.

Figure 15:
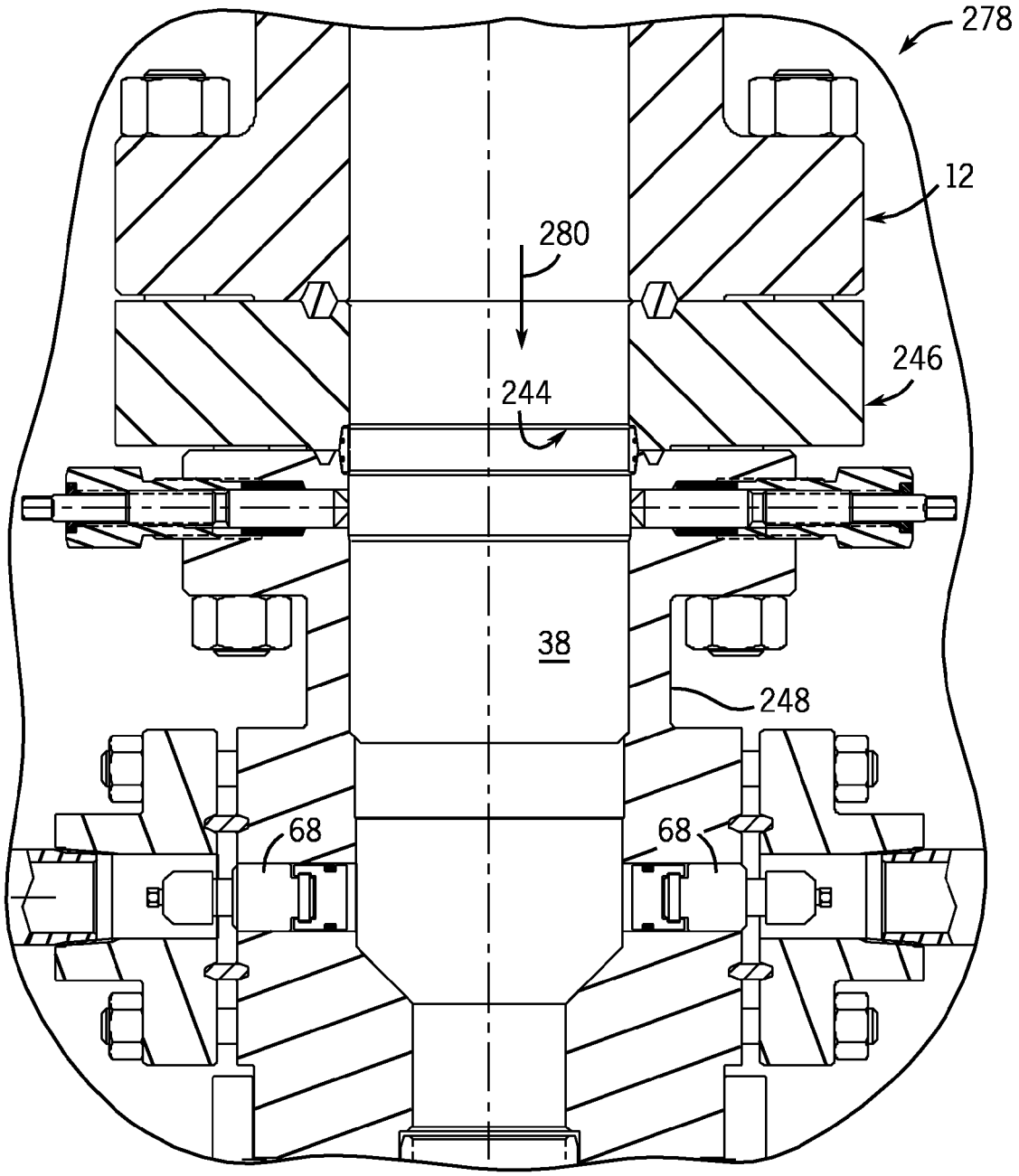
FIG. 15 is a cross-sectional side view of the wellhead of FIG. 14 during an example of a fracing process in accordance with embodiments of the present technique.

In some embodiments, the wellhead 278 may be fraced without the pressure-barrier hanger 136 installed. FIG. 15 is a cross-sectional view of the embodiment of the wellhead 278 in such a state. Fracing fluid may flow through the central passage 38 without being impeded by the pressure-barrier hanger 136, as illustrated by arrow 280. After fracing, the pressure-barrier hanger 136 may be installed with a pressure barrier by inserting them through a frac tree coupled to the adapter 246. The pressure-barrier hanger 136 and pressure barrier may then seal the central passage 38 while the frac tree is removed and a tree or blowout preventer is installed. In some embodiments, the pressure barrier and the pressure barrier hanger 136 may be integrally formed as a single component, or the pressure-barrier hanger 136 may be omitted and other features, such as the casing hanger 52 (FIG. 2), the tubing head 248, or the adapter 246 may secure the pressure barrier.

Figure 16:
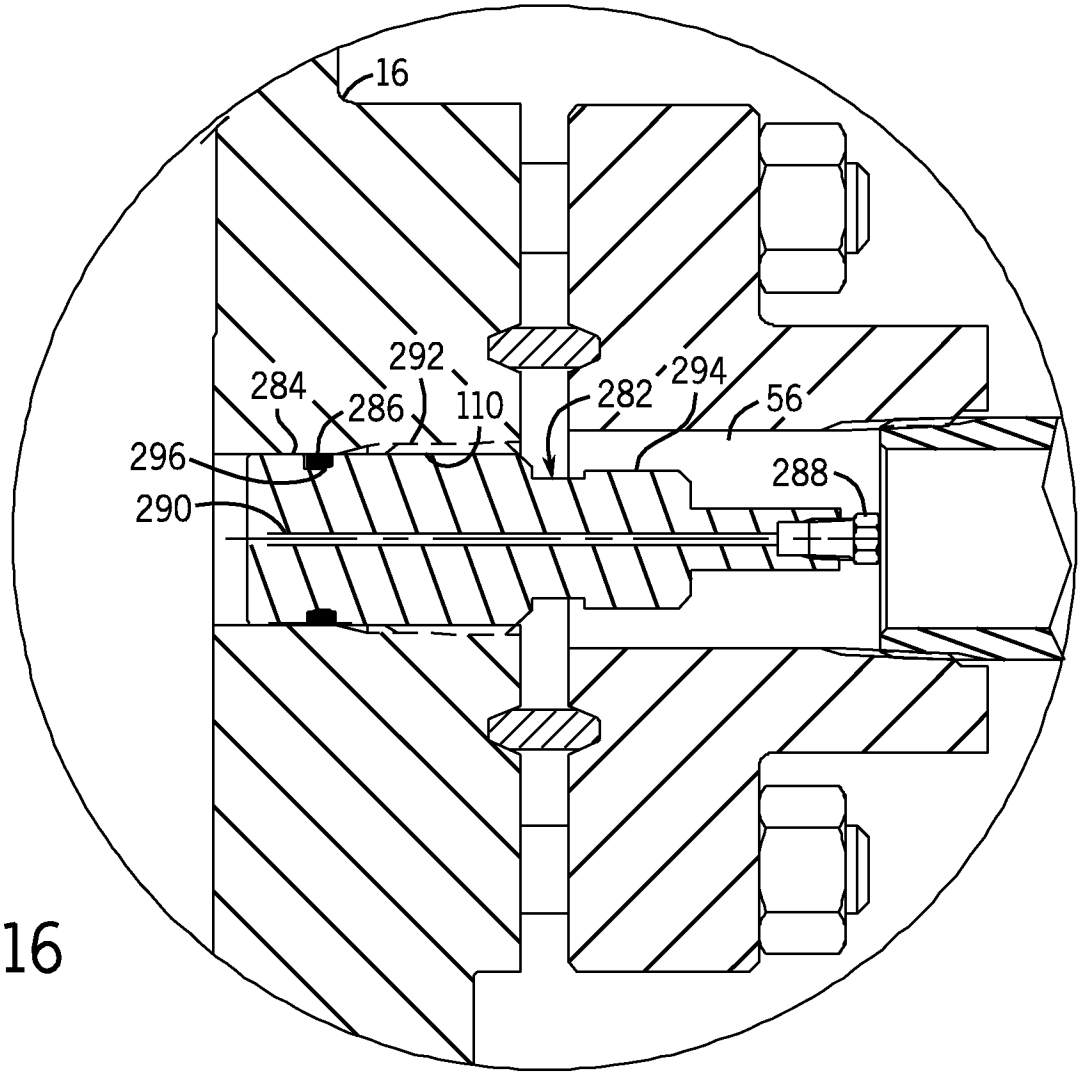
FIG. 16 is a cross-sectional side view of a second example of a side plug in accordance with an embodiment of the present technique.

FIG. 16 is a cross-sectional view of another embodiment of a side plug 282. The side plug 282 includes a body 284, an annular seal 286, and a valve 288. The body 284 may be a one-piece body made of steel or other appropriate materials. The body includes a passage 290 that extends through the body 284 to the valve 288. Threads 292 mate with threads 110 on the tubing head 16 to secure the side plug 282. A tool interface 294 may be similar to the tool interface 100 described above with respect to FIG. 3, and the valve 288 may be similar to the valve 78 described above. In other embodiments, the side plug 282 may not include the valve 288 or the passage 290. The seal 286 may be disposed in an annular groove 296 in the body 284. The seal 286 may be a generally annular body made of or including an elastomer, metal, or other appropriate materials. The side plug 288 may be used in combination with any of various wellhead components described above to seal the side passages 56 or 58 (FIG. 2). Further, the side plug 282 may be used to execute the processes described above with respect to the FIGS. 7-9, except, in some embodiments, for the steps relating to movement of an inner member and an outer member.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a plug, comprising:

an outer member;

an inner member extending through the outer member; and a moveable seal disposed around the outer member, wherein the moveable seal is configured to move and seal against an exterior of the plug in response to relative movement between the inner member and the outer member, the outer member comprises a first portion with a narrower diameter and a second portion with a wider diameter, and the moveable seal is configured to radially expand upon axial movement from the first portion with the narrower diameter to the second portion with the wider diameter.

2. The system of claim 1, comprising a seal actuator coupled to the inner member, wherein the seal actuator is configured to move the inner member by applying a force to the outer member.

3. The system of claim 2, wherein:

the seal actuator comprises a first tool interface, wherein the seal actuator is coupled to the inner member with threads, and wherein the threads are configured to move the inner member relative to the outer member in response to rotation of the seal actuator; and the outer member comprises a second tool interface.

4. The system of claim 1, wherein the inner member comprises a tubular flange configured to overlap a distal portion of the outer member and move the moveable seal.

5. The system of claim 1, wherein the outer member comprises external threads configured to mate with complementary internal threads on a side passage of a wellhead.

6. The system of claim 5, comprising the wellhead coupled to the plug.

7. The system of claim 6, wherein a central passage of the wellhead is coupled to and is aligned with production casing of a well, and wherein the side passage extends at generally a 90 degree angle relative to the central passage, and wherein the moveable seal is generally annular member configured to expand radially in response to axial movement of the inner member relative to the outer member.

8. The system of claim 6, comprising a side valve coupled to the side passage, wherein the side valve is disposed on an opposite side of the plug relative to a central passage of the wellhead.

9. The system of claim 1, comprising a check valve coupled to the plug.

10. The system of claim 9, wherein the inner member comprises a passage extending through the inner member, and wherein the check valve is coupled to the inner member and an inlet or outlet of the check valve is in fluid communication with the passage.

11. The system of claim 1, wherein the plug comprises a passage extending completely axially through the inner member.

12. The system of claim 1, comprising a wellhead having the plug disposed within a side passage, wherein the at least one axial blocking fastener couples the outer member to a wall of the wellhead.

13. The system of claim 1, comprising a wellhead having the plug disposed within a side passage, wherein the moveable seal is sealed in the side passage within a wall of the wellhead.

14. The system of claim 1, wherein the inner member has only one degree of freedom of movement in an axial direction relative to the outer member, and the inner member is driven to move in the axial direction via a seal actuator completely external to both the inner member and the outer member.

15. The system of claim 1, wherein the plug comprises a first axial blocking fastener disposed on an exterior of the outer member, wherein the first axial blocking fastener is configured to engage with a second axial blocking fastener to block axial movement of the outer member.

16. The system of claim 15, wherein the first axial blocking fastener comprises a threaded fastener.

17. The system of claim 15, wherein the first axial blocking fastener comprises a lock ring disposed in a groove.

18. The system of claim 15, wherein the first axial blocking fastener comprises a lockdown pin disposed in a groove.

19. The system of claim 1, wherein the inner member is coupled to the outer member with at least one degree of freedom of movement relative to the outer member.

20. A system, comprising:

a plug, comprising:

an outer member;

an inner member extending through the outer member; and a moveable seal disposed around the outer member, wherein the moveable seal is configured to move and seal against an exterior of the plug in response to relative movement between the inner member and the outer member, and the outer member comprises external threads configured to mate with complementary internal threads on a side passage of a wellhead.

21. The system of claim 20, comprising the wellhead having the plug disposed in the side passage.

22. A system, comprising:

a plug, comprising:

an outer member;

an inner member extending through the outer member; and a moveable seal disposed around the outer member, wherein the moveable seal is configured to move and seal against an exterior of the plug in response to relative movement between the inner member and the outer member; and a check valve coupled to the plug.

23. The system of claim 22, wherein the inner member comprises a passage extending through the inner member, and the check valve is coupled to the inner member and an inlet or outlet of the check valve is in fluid communication with the passage.

24. A system, comprising:

a head having a central bore extending between opposite first and second axial ends, a first flange at the first axial end, and a side passage intersecting the central bore between the first and second axial ends;

a tubular component having a second flange, wherein the first and second flanges are coupled together at a mating interface between the head and the tubular component;

a seal ring disposed between head and the tubular component at the mating interface; and a plug disposed in the side passage.

25. The system of claim 24, wherein the plug comprises an outer member, an inner member extending through the outer member, and a moveable seal disposed around the outer member, wherein the moveable seal is configured to move and seal between the plug and the side passage in response to relative movement between the inner member and the outer member.

26. The system of claim 24, comprising a sleeve disposed in the central bore of the head, wherein an entire axial length of the sleeve is disposed between the first and second axial ends of the head, or between the first axial end and the side passage.

27. A system, comprising:

a head having a central bore extending between opposite first and second axial ends, and a side passage intersecting the central bore between the first and second axial ends; and a sleeve disposed in the central bore of the head, wherein an entire axial length of the sleeve is disposed between the first and second axial ends of the head, or between the first axial end and the side passage.

28. The system of claim 27, comprising a plug disposed in the side passage.

29. The system of claim 28, wherein the plug comprises an outer member, an inner member extending through the outer member, and a moveable seal disposed around the outer member, wherein the moveable seal is configured to move and seal between the plug and the side passage in response to relative movement between the inner member and the outer member.

30. The system of claim 27, wherein the entire axial length of the sleeve is disposed between the first and second axial ends of the head.

31. The system of claim 27, wherein the entire axial length of the sleeve is disposed between the first axial end and the side passage.

32. The system of claim 27, comprising a seal ring disposed at the first axial end of the head.

33. The system of claim 32, comprising a tubular component coupled to the head at the first axial end, wherein the head comprises a first flange at the first axial end, the tubular component comprises a second flange, the first and second flanges are coupled together at a mating interface, and the seal ring is disposed between the head and the tubular component at the mating interface.

34. The system of claim 27, wherein the sleeve comprises a pressure-barrier hanger.

* * * * *